US006846794B1

(12) United States Patent
Ingram et al.

(10) Patent No.: US 6,846,794 B1
(45) Date of Patent: Jan. 25, 2005

(54) PRODUCTION PROCESS FOR DETERGENT TABLET

(75) Inventors: David William Ingram, Brussels (BE); Ingrid Maria Elisabeth Hendrika Willems, Leuven (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/914,493

(22) PCT Filed: Feb. 29, 2000

(86) PCT No.: PCT/US00/05292

§ 371 (c)(1),
(2), (4) Date: Aug. 29, 2001

(87) PCT Pub. No.: WO00/52129

PCT Pub. Date: Sep. 8, 2000

(30) Foreign Application Priority Data

Mar. 5, 1999 (EP) ..... 99870039

(51) Int. Cl.[7] ..... C11D 11/00; C11D 17/00

(52) U.S. Cl. ..... 510/446; 510/224; 510/294; 510/298

(58) Field of Search ..... 510/446, 224, 510/294, 298

(56) References Cited

U.S. PATENT DOCUMENTS

| | | | | |
|---|---|---|---|---|
| 4,460,490 | A | | 7/1984 | Barford et al. |
| 5,759,976 | A | | 6/1998 | Roach et al. ..... 510/218 |
| 5,759,977 | A | * | 6/1998 | van den Brom et al. ... 510/224 |
| 6,329,335 | B1 | * | 12/2001 | Feist et al. ..... 510/446 |

FOREIGN PATENT DOCUMENTS

| | | | |
|---|---|---|---|
| CN | 1178829 | A * | 4/1998 |
| EP | 0 711 828 | A2 | 5/1996 |
| EP | 0 716 144 | A2 | 6/1996 |
| EP | 0 896 052 | A1 | 2/1999 |
| GB | 1 307 387 | | 2/1973 |
| JP | 6207199 | A1 | 7/1994 |

* cited by examiner

*Primary Examiner*—Lorna M. Douyon
(74) *Attorney, Agent, or Firm*—Marianne Dressman; Mark A. Charles; Brahm J. Corstanje

(57) ABSTRACT

A process for making a non-phosphate, zeolite-built detergent tablet, the process comprising a first step of providing a detergent composition, a second step of forming a particulate material comprising the detergent composition, and a third step of compressing the particulate material in a tablet form, the process being characterized in that it further comprises a step of cooling the detergent composition below ambient temperature between the first and the third step.

8 Claims, No Drawings

PRODUCTION PROCESS FOR DETERGENT TABLET

The present invention relates to a process for producing detergent tablets.

Detergent tablets are now widely used in autodish washing application, and are starting to be used in laundry applications. These tablets are produced by industrial processes which typically involve compressing a particulate material into a tablet form, the particulate material being typically formed from a detergent composition.

The present invention concerns a process for making a detergent tablet, the process comprising a first step of providing a detergent composition, a second step of forming a particulate material comprising the detergent composition, and a third step of compressing the particulate material in a tablet form. Such a process is known from EP-A2-0 711 828.

Among the advantage of such processes is that it allows to produce relatively solid tablets based on classic detergent powders, thus reducing the messiness induced by handling of detergent compositions in a fluid form (powder, granules, liquid, gels or paste) while having a tablet form which remains based on technologies already developed for particulate materials. Further tablets provide additional dosing accuracy by avoiding over-dosing or under-dosing.

While having these and other advantages, the detergent tablets obtained by such processes have disadvantages. For example, the compression of the particulate material leads to dissolution characteristics which are difficult to maintain compared to detergent compositions in a fluid form.

The invention seeks to provide a process for making a detergent tablet of the above mentioned kind which leads to detergent tablets having improved dissolution characteristics, while maintaining the mechanical integrity of the tablets.

SUMMARY OF THE INVENTION

In accordance with the invention, this object is accomplished in a process of the above mentioned kind in that it further comprises a step of cooling the detergent composition below ambient temperature between the first and the third step.

DETAILED DESCRIPTION OF THE INVENTION

The invention relates to a process for making a detergent tablet. By a tablet, it should be understood a solid block, which may take various shapes, and have various sizes. By a detergent tablet, it should be understood a tablet containing detergent, i.e. typically containing surfactants. This type of tablet is usually used for cleaning purposes.

The process of the invention comprises a first step of providing a detergent composition. The detergent composition may be provided in various forms, and comprise a mixture of different materials. The process also comprises a second step of forming a particulate material comprising the detergent composition. The particulate material may be formed in different ways, which are exemplified below. It should be noted that the particulate material comprises the detergent composition but may also comprise other ingredients. The process further comprises a third step of compressing the particulate material in a tablet form. Again, various ways to obtain a tablet by compressing a particulate material are described hereby, although other ways may be useful.

The process is characterised in that it further comprises a step of cooling the detergent composition below ambient temperature between the first and the third step. The ambient temperature is considered to be the ambient temperature on the production side in the tabletting area. For example, this ambient temperature is the ambient temperature in the surroundings of the tabletting machine. It should be noted that in particular cases, for example in the summer, the ambient temperature of a production site can reach relatively high temperatures, often above 25° C., sometimes above 30° C. The process according to the invention was found particularly useful in such high temperature environments. Indeed, in a preferred embodiment, the ambient temperature is of more than 18° C., even more preferably of more than 20° C. By cooling below ambient temperature, it should be understood that sometime between the first and the third step, the detergent composition is being brought to a temperature which is below the ambient temperature. The cooling may take place anytime between the first and third step, for example in storage silos, in spray drum machines, in Loedige KM machines, or during storage between the second and the third step for example. Indeed, in a preferred embodiment, the step of cooling the detergent composition consists in exposing the detergent composition to a temperature below ambient temperature in a portion of space. However, other means of cooling may also be used, such as de-pressurisation for example. Even more preferably, the exposition is provided by placing or displacing the detergent composition in or through the portion of space in which the temperature is below ambient temperature for a given exposition time. This may be achieved for example by placing the detergent composition in a silo, whereby the temperature inside of the silo is below ambient temperature, or by displacing the detergent composition through a cooling tunnel at some stage during the process, or simply by having a cooling air current situated on the production line. Cooling may also be provided by means of liquid nitrogen or solid $CO_2$, the advantage of the use of such products being that they are chemically neutral as they normally do not react with a detergent composition, and that they are vaporising as soon as released in the ambient temperature.

It should be noted that the process according to the invention was found particularly useful for cooling a detergent composition which is at a temperature above ambient temperature prior to the cooling step. Indeed, even though the ambient temperature will lower the temperature of the detergent composition having a temperature above ambient, such a detergent composition will be cooled faster by applying a temperature under ambient temperature as described in the process of the invention. This particular aspect may be useful in a wide range of ambient temperature, i.e. an ambient temperature of at least 5° C. more preferably of at least 10° C., and even more preferably of at least 15° C. Further, it should be noted that the cooling step is rendered even more efficient when the cooling is provided by a stream, the stream being formed either by projecting a liquid ($N_2$ for example) or gaseous (air for example) fluid, or even solid such as $CO_2$ onto the detergent composition, or by having the detergent composition displaced through such a fluid, or by a combination of both, in order to increase the heat transfer between the cooling gaseous or liquid fluid and the detergent composition.

The process according to the invention is preferred when the difference of temperature between the ambient temperature and the temperature below ambient temperature is of at least 3° C., more preferably of at least 5° C. It is even more preferred with a difference of at least 10° C.

In an other preferred embodiment, the exposition time is proportional to the weight of detergent composition exposed divided by the difference of temperature between the ambient temperature and the temperature below ambient temperature of the cooling step. For example, in a production line having a debit of from 5 tons per hour up to 100 tons an hour (preferably of at least 10 tons per hour and of less than 65 tons per hour) of detergent composition, the detergent composition is preferably exposed for 30 seconds to a steam of liquid nitrogen, the steam of liquid nitrogen having a debit of from 2 and up to 10 tons per hour.

In a preferred embodiment, the detergent composition comprises at least 10% by weight of surfactant, more preferably at least 15% of surfactant, even more preferably more than 20% of surfactant, or at least 2% by weight of binder, more preferably at least 3% of binder, even more preferably at least 5% of binder and most preferably at least 7% of binder. Indeed, without wishing to be bound by theory, it is believed that the improved disintegration of the tablet according to the invention may be due to a morphological change of one of these ingredients due to the temperature difference.

In a most preferred embodiment, the detergent composition has a temperature below ambient temperature after the cooling step and before the third step, this being due to the cooling of the detergent composition. Preferably, the detergent composition has a temperature of at least 2° C. below ambient temperature, more preferably 5° C. and most preferably 10° C.

A tablet obtainable by the process of the invention was found to dispense more readily.

The tablets may comprise components such as fragrance, surfactants, enzymes, detergents etc. . . . Typical tablet compositions for the preferred embodiment of the present invention are disclosed in the pending European applications of the Applicant no. 96203471.6, publication no. 846,755, publication date Jun. 10, 1998, 96203462.5, publication no. 846,798, publication date Jun. 10, 1998, 96203473.2, publication no. 846,756, publication date Jun. 10, 1998, and 96203464.1, publication no. 846,754, publication date Jun. 10, 1998, for example. Elements typically entering in the composition of detergent tablets or of other forms of detergents such as liquids or granules are detailed in the following paragraphs.

Highly Soluble Compounds

The tablet may comprise a highly soluble compound. Such a compound could be formed from a mixture or from a single compound. A highly soluble compound is defined as follow:

A solution is prepared as follows comprising de-ionised water as well as 20 grams per liter of a specific compound:

1—20 g of the specific compound is placed in a Sotax Beaker. This beaker is placed in a constant temperature bath set at 10° C. A stirrer with a marine propeller is placed in the beaker so that the bottom of the stirrer is at 5 mm above the bottom of the Sotax beaker. The mixer is set at a rotation speed of 200 turns per minute.

2—980 g of the de-ionised water is introduced into the Sotax beaker.

3—10 s after the water introduction, the conductivity of the solution is measured, using a conductivity meter.

4—Step 3 is repeated after 20, 30, 40, 50, 1 min, 2 min, 5 min and 10 min after to step 2.

5—The measurement taken at 10 min is used as the plateau value or maximum value.

The specific compound is highly soluble according to the invention when the conductivity of the solution reaches 80% of its maximum value in less than 10 seconds, starting from the complete addition of the de-ionised water to the compound. Indeed, when monitoring the conductivity in such a manner, the conductivity reaches a plateau after a certain period of time, this plateau being considered as the maximum value. Such a compound is preferably in the form of a flowable material constituted of solid particles at temperatures comprised between 10 and 800 Celsius for ease of handling, but other forms may be used such as a paste or a liquid.

Example of highly soluble compounds include Sodium di isoalkylbenzene sulphonate (DIBS) or Sodium toluene sulphonate for example.

Cohesive Effect

The tablet may comprise a compound having a Cohesive Effect on the particulate material of a detergent matrix forming the tablet. The Cohesive Effect on the particulate material of a detergent matrix forming the tablet or a layer of the tablet is characterised by the force required to break a tablet or layer based on the examined detergent matrix pressed under controlled compression conditions. For a given compression force, a high tablet or layer strength indicates that the granules stuck highly together when they were compressed, so that a strong cohesive effect is taking place. Means to assess tablet or layer strength (also refer to diametrical fracture stress) are given in Pharmaceutical dosage forms: tablets volume 1 Ed. H. A. Lieberman et al, published in 1989.

The cohesive effect is measured by comparing the tablet or layer strength of the original base powder without compound having a cohesive effect with the tablet or layer strength of a powder mix which comprises 97 parts of the original base lb powder and 3 parts of the compound having a cohesive effect. The compound having a cohesive effect is preferably added to the matrix in a form in which it is substantially free of water (water content below 10% (pref. below 5%)). The temperature of the addition is between 10 and 80 C, more pref. between 10 and 40 C.

A compound is defined as having a cohesive effect on the particulate material according to the invention when at a given compacting force of 3000N, tablets with a weight of 50 g of detergent particulate material and a diameter of 55 mm have their tablet tensile strength increased by over 30% (preferably 60 and more preferably 100%) by means of the presence of 3% of the compound having a cohesive effect in the base particulate material.

An example of a compound having a cohesive effect is Sodium di isoalkylbenzene sulphonate.

When integrating a highly soluble compound having also a cohesive effect on the particulate material used for a tablet or layer formed by compressing a particulate material comprising a surfactant, the dissolution of the tablet or layer in an aqueous solution is significantly increased. In a preferred embodiment, at least 0.5% per weight of a tablet or layer is formed from the highly soluble compound, more preferably at least 0.75%, even more preferably at least 2% and most preferably at least 40/per weight of the tablet or layer being formed from the highly soluble compound having a cohesive effect on the particulate material.

It should be noted that a composition comprising a highly soluble compound as well as a surfactant is disclosed in EP-A-0 524 075, this composition being a liquid composition.

A highly soluble compound having a cohesive effect on the particulate material allows to obtain a tablet having a higher tensile strength at constant compacting force or an equal tensile strength at lower compacting force when compared to traditional tablets. Typically, a whole tablet will have a tensile strength of more than 5 kPa, preferably of more than 10 kPa, more preferably, in particular for use in laundry applications, of more than 15 kPa, even more preferably of more than 30 kPa and most preferably of more than 50 kPa, in particular for use in dish washing or auto dish washing applications; and a tensile strength of less than 300 kPa, preferably of less than 200 kPa, more preferably of less than 100 kPa, even more preferably of less than 80 kPa and most preferably of less than 60 kPa. Indeed, in case of laundry application, the tablets should be less compressed than in case of auto dish washing applications for example, whereby the dissolution is more readily achieved, so that in a laundry application, the tensile strength is preferably of less than 30 kPa.

This allows to produce tablets or layers which have a solidity and mechanical resistance comparable to the solidity or mechanical resistance of traditional tablets while having a less compact tablet or layer thus dissolving more readily.

Furthermore, as the compound is highly soluble, the dissolution of the tablet or layer is further facilitated, resulting in a synergy leading to facilitated dissolution for a tablet according to the invention.

Tablet Manufacture

The tablet may comprise several layers. For the purpose of manufacture of a single layer, the layer may be considered as a tablet itself.

Detergent tablets can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients.

In particular for laundry tablets, the ingredients such as builder and surfactant can be spray-dried in a conventional manner and then compacted at a suitable pressure. Preferably, the tablets according to the invention are compressed using a force of less than 100000N, more preferably of less than 50000N, even more preferably of less than 5000N and most preferably of less than 3000 N. Indeed, the most preferred embodiment is a tablet suitable for laundry compressed using a force of less than 2500N, but tablets for auto dish washing may also be considered for example, whereby such auto dish washing tablets are usually more compressed than laundry tablets.

The particulate material used for making a tablet can be made by any particulation or granulation process. An example of such a process is spray drying (in a co-current or counter current spray drying tower) which typically gives LT, low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). Non-gelling binder can be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the binder, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 20 mm and 60 mm, preferably of at least 35 and up to 55 mm, and a weight between 25 and 100 g. The ratio of height to diameter (or width) of the tablets is preferably greater than 1:3, more preferably greater than 1:2. In another preferred embodiment, the tablets have a square cross-section of 45 mm by 45 mm and are 25 mm high. The compaction pressure used for preparing these tablets need not exceed 100000 kN/m$^2$, preferably not exceed 30000 kN/m$^2$, more preferably not exceed 5000 kN/m$^2$, even more preferably not exceed 300 kN/m$^2$ and most preferably not exceed 1000 kN/m$^2$. In a preferred embodiment according to the invention, the tablet has a density of at least 0.9 g/cc, more preferably of at least 1.0 g/cc, and preferably of less than 2.0 g/cc, more preferably of less than 1.5 g/cc, even more preferably of less than 1.25 g/cc and most preferably of less than 1.15 g/cc.

Multi layered tablets are typically formed in rotating presses by placing the particulate material of each layer, one after the other in force feeding flasks. As the process continues, the particulate material layers are then pressed together in the pre-compression and compression stages stations to form the multilayer tablet. With some rotating presses it is also possible to compress the first feed layer before compressing the whole tablet.

Hydrotrope Compound

A highly soluble compound having a cohesive effect may be integrated to a detergent tablet, whereby this compound is also a hydrotrope compound. Such hydrotrope compound may be generally used to favour surfactant dissolution by avoiding gelling. A specific compound is defined as being hydrotrope as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.

2. Octanoic Acid is thereafter added to the solution in a proportion of 1.6 times the weight of the specific compound in solution, the solution being at a temperature of 20° Celsius. The solution is mixed in a Sotax beaker with a stirrer with a marine propeller, the propeller being situated at about 5 mm above the bottom of the beaker, the mixer being set at a rotation speed of 200 rounds per minute.

3. The specific compound is hydrotrope if the the Octanoic Acid is completely solubilised, i.e. if the solution comprises only one phase, the phase being a liquid phase.

It should be noted that in a preferred embodiment of the invention, the hydrotrope compound is a flowable material made of solid particles at operating conditions between 15 and 600 Celsius.

Hydrotrope compounds include the compounds listed thereafter:

A list of commercial hydrotropes could be found in McCutcheon's Emulsifiers and Detergents published by the McCutcheon division of Manufacturing Confectioners Company. Compounds of interest also include:

1. Nonionic hydrotrope with the following structure:

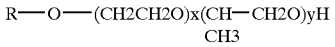

where R is a C8–C10 alkyl chain, x ranges from 1 to 15, y from 3 to 10.

2. Anionic hydrotropes such as alkali metal aryl sulfonates. This includes alkali metal salts of benzoic acid, salicylic acid, bezenesulfonic acid and its many derivatives, naphthoic acid and various hydroaromatic acids. Examples of these are sodium, potassium and ammonium benzene sulfonate salts derived from toluene sulfonic acid, xylene sulfonic acid, cumene sulfonic acid, tetralin sulfonic acid, naphtalene sulfonic acid, methyl-naphtalene sulfonic acid, dimethyl naphtalene sulfonic acid, trimethyl naphtalene sulfonic acid=

Other examples include salts of dialkyl benzene sulfonic acid such as salts of diisopropyl benzene sulfonic acid, ethyl methyl benzene sulfonic acid, alkyl benzene sulfonic acid with an alkyl chain length with 3 to 10, (pref. 4 to 9), linear or branched alkyl sulfonates with an alkyl chain with 1 to 18 carbons.

3. Solvent hydrotropes such as alkoxylated glycerines and alkoxylated glycerides, esters slakoxylated glycerines, alkoxylated fatty acids, esters of glycerin, polyglycerol esters. Preferred alkoxylated glycerines have the following structure:

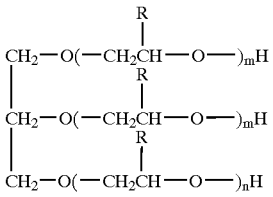

where l, m and n are each a number from 0 to about 20, with l+m+n=from about 2 to about 60, preferably from about 10 to about 45 and R represents H, $CH_3$ or $C_2H_5$ Preferred alkoxylated glycerides have the following structure

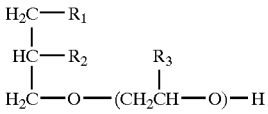

where R1 and R2 are each $C_nCOO$ or —(CH2CHR$_3$—O)H where $R_3$=H, $CH_3$ or $C_2H_5$ and I is a number from 1 to about 60, n is a number from about 6 to about 24.

4. Polymeric hydrotropes such as those described in EP636687:

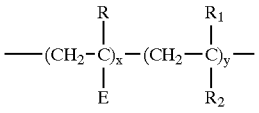

where E is a hydrophilic functional group,

R is H or a C1–$C_{10}$ alkyl group or is a hydrophilic functional group;

R1 is H a lower alkyl group or an aromatic group,

R2 is H or a cyclic alkyl or aromatic group.

The polymer typically has a molecular weight of between about 1000 and 1000000.

5. Hydrotrope of unusual structure such as 5-carboxy-4-hexyl-2-cyclohexene-1-yl octanoic acid (Diacid®)

Use of such compound in the invention would further increase the dissolution rate of the tablet, as a hydrotrope compound facilitates dissolution of surfactants, for example. Such a compound could be formed from a mixture or from a single compound.

Tensile Strength

For the purpose of measuring tensile strength of a layer, the layer may be considered as a tablet itself.

Depending on the composition of the starting material, and the shape of the tablets, the used compacting force may be adjusted to not affect the tensile strength, and the disintegration time in the washing machine. This process may be used to prepare homogenous or layered tablets of any size or shape.

For a cylindrical tablet, the tensile strength corresponds to the diametrical fracture stress (DFS) which is a way to express the strength of a tablet or layer, and is determined by the following equation:

$$\text{Tensile strength}=2F/\pi Dt$$

Where F is the maximum force (Newton) to cause tensile failure (fracture) measured by a VK 200 tablet hardness tester supplied by Van Kell industries, Inc. D is the diameter of the tablet or layer, and t the thickness of the tablet or layer. For a non round tablet, πD may simply be replaced by the perimeter of the tablet.

(Method Pharmaceutical Dosage Forms: Tablets Volume 2 Page 213 to 217). A tablet having a diametral fracture stress of less than 20 kPa is considered to be fragile and is likely to result in some broken tablets being delivered to the consumer. A diametral fracture stress of at least 25 kPa is preferred.

This applies similarly to non cylindrical tablets, to define the tensile strength, whereby the cross section normal to the height of the tablet is non round, and whereby the force is applied along a direction perpendicular to the direction of the height of the tablet and normal to the side of the tablet, the side being perpendicular to the non round cross section.

Tablet Dispensing

The rate of dispensing of a detergent tablet can be determined in the following way:

Two tablets, nominally 50 grams each, are weighed, and then placed in the dispenser of a Baucknecht® WA9850 washing machine. The water supply to the washing machine is set to a temperature of 20° C. and a hardness of 21 grains per gallon, the dispenser water inlet flow-rate being set to 8 l/min. The level of tablet residues left in the dispenser is checked by switching the washing on and the wash cycle set to wash program 4 (white/colors, short cycle). The dispensing percentage residue is determined as follows:

$$\%\ \text{dispensing}=\text{residue weight}\times 100/\text{original tablet weight}$$

The level of residues is determined by repeating the procedure 10 times and an average residue level is calculated based on the ten individual measurements. In this stressed test a residue of 40% of the starting tablet weight is considered to be acceptable. A residue of less than 30% is preferred, and less than 25% is more preferred.

It should be noted that the measure of water hardness is given in the traditional "grain per gallon" unit, whereby 0.001 mole per liter=7.0 grain per gallon, representing the concentration of $Ca^{2+}$ ions in solution.

Effervescent

Detergent tablets may further comprise an effervescent.

Effervescency as defined herein means the evolution of bubbles of gas from a liquid, as the result of a chemical reaction between a soluble acid source and an alkali metal carbonate, to produce carbon dioxide gas, i.e. $C_6H_8O_7+3NaHCO_3 \rightarrow Na_3C_6H_5O_7+3CO_2\uparrow+3H_2O$ Further examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles.

Due to the gas created by the effervescency in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dissolution aid could be provided by using compounds such as sodium acetate or urea. A list of suitable dissolution aid may also be found in Pharmaceutical Dosage Forms: Tablets, Volume 1, Second edition, Edited by H. A. Lieberman et all, ISBN 0-8247-8044-2.

Coating

Solidity of a tablet may be improved by making a coated tablet, the coating covering a non-coated tablet, thereby improving the mechanical characteristics of the tablet.

This very advantageously applies to multi-layer tablets, whereby the mechanical characteristics of a more elastic layer can be transmitted via the coating to the rest of the tablet, thus combining the advantage of the coating with the advantage of the more elastic layer. Indeed, mechanical constraints will be transmitted through the coating, thus improving mechanical integrity of the tablet. In one embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably rid brittle so that the tablet breaks up quickly when subjected to stronger mechanical shock. Furthermore it is advantageous if the coating material is dissolved under alkaline conditions, or is readily emulsified by surfactants. This contributes to avoiding the problem of visible residue in the window of a front-loading washing machine during the wash cycle, and also avoids deposition of undissolved particles or lumps of coating material on the laundry load.

Water solubility is measured following the test protocol of ASTM E1148-87 entitled, "Standard Test Method for Measurements of Aqueous Solubility".

The coating material has a melting point preferably of from 40° C. to 200° C.

The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. During the solidification phase, the coating undergoes some internal stress (e.g. shrinkage upon cooling) and external stress (e.g. tablet relaxation). This will likely cause some cracks in the structure such as edge splitting if the coating material is too brittle to withstand these mechanical stress, which is often the case when a coating is solely made from components solid at 25° C. Indeed, it is preferred that the coating comprises a component which is liquid at 25° C. It is believed that this liquid component will allow the coating to better withstand and absorb mechanical stress by rendering the coating structure more flexible. The component which is liquid at 25° C. is preferably added to the coating materials in proportions of less than 10% by weight of the coating, more preferably less than 5% by weight, and most preferably of less than 3% by weight. The component which is liquid at 25° C. is preferably added to the coating materials in proportions of more than 0.1% by weight of the coating, more preferably more than 0.3% by weight, and most preferably of more than 0.5% by weight. Further preferred is the addition of reinforcing fibres to the coating in order to further reinforce the structure.

Preferably, the coating comprises a crystallised structure. By crystallised, it should be understood that the coating comprises a material which is solid at ambient temperature (25° C.) and has a structure exhibiting some order. This can be detected typically by usual crystallography techniques e.g. X-ray analysis, on the material itself. In a more preferred embodiment, the material forming the crystallised structure does not co-crystallised or only partially with the optional component which is liquid at 25° C. mentioned above. Indeed, it is preferred that the optional component remains in the liquid state at 25° C. in the coating crystalline structure in order to provide flexibility to the structure and resistance to mechanical stress. In another embodiment, the optional component which is liquid at 25° C. may advantageously have a functionality in the washing of laundry, for example silicone oil which provides suds suppression benefits or perfume oil. The coating may also comprise other optional components. Suitable coating materials are for example dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. Most preferred is adipic acid.

Clearly substantially insoluble materials having a melting point below 40° C. are often not sufficiently solid at ambient temperatures and it has been found that materials having a melting point above about 200° C. are not practicable to use.

Preferably, an acid having a melting point of more than 90° C. such as azelaic, sebacic acid, dodecanedioic acid is used. It is even more preferred to use an acid having a melting point of more than 145° C. such as adipic acid.

By "melting point" is meant the temperature at which the material when heated slowly in, for example, a capillary tube becomes a clear liquid.

A coating of any desired thickness can be applied according to the present invention. For most purposes, the coating forms from 1% to 10%, preferably from 1.5% to 5%, of the tablet weight.

Tablet coatings are very hard and provide extra strength to the tablet.

Examples of optional components which are liquid at 250 are including PolyEthylene Glycols, thermal oil, silicon oil, esters of dicarboxylic acids, mono carboxylic acids, parafin, triacetin, perfumes or alkaline solutions. It is preferred that the structure of the components which is liquid at 25° C. is close to the material forming the crystallised structure, so that the structure is not excessively disrupted. In a most preferred embodiment, the crystallised structure is made of adipic acid, the component which is liquid at 25° C. being available under the name Coasol™ from Chemoxy International, being a blend of the di-isobutyl esters of the glutaric, succinic and adipic acid. The advantage of the use of this component being the good dispersion in the adipic acid to provide flexibility. It should be noted that disintegration of the adipic acid is further improved by the adipate content of Coasol™.

Fracture of the coating in the wash can be improved by adding a disintegrant in the coating. This disintegrant will swell once in contact with water and break the coating in small pieces. This will improve the dissolution of the coating in the wash solution. The disintegrant is suspended in the coating melt at a level of up to 30%, preferably between 5% and 20%, most preferably between 5 and 10% by weight. Possible disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins, polymers containing cationic (e.g. quaternary ammonium) groups, amine-substituted polyacrylates, polymerised cationic amino acids such as poly-L-lysine, polyallylamine hydrochloride) and mixtures thereof.

Preferably, the coating comprises an acid having a melting temperature of at least 145° C., such as adipic acid for example, as well as a clay, such as a bentonite clay for example, whereby the clay is used as a disintegrant and also to render the structure of adipic acid more favourable for water penetration, thus improving the dispersion of the adipic acid in a aqueous medium. Preferred are clays having a particle size of less than 75 $\mu$m, more preferably of less than 53 $\mu$m, in order to obtain the desired effect on the structure of the acid. Preferred are bentonite clays. Indeed the acid has a melting point such that traditional cellulosic disintegrants undergo a thermal degradation during the coating process, whereas such clays are found to be more heat stable. Further, traditional cellulosic disintegrant such as Nymcel™ for example are found to turn brown at these temperatures.

In another preferred embodiment, the coating further comprises reinforcing fibres. Such fibres have been found to improve further the resistance of the coating to mechanical stress and minimise the splitting defect occurence. Such fibres are preferably having a length of at least 100 $\mu$m, more preferably of at least 200 $\mu$m and most preferably of at least 250 $\mu$m to allow structure reinforcement. Such fibres are preferably having a length of at less than 500 $\mu$m, more preferably of less than 400 $\mu$m and most preferably of less than 350 $\mu$m in order not to impact onto dispersion of the coating in an aqueous medium. Materials which may be used for these fibres include viscose rayon, natural nylon, synthetic nylon (polyamides types 6 and 6,6), acrylic, polyester, cotton and derivatives of cellulose such as CMCs. Most preferred is a cellulosic material available under the trade mark Solka-Floc™ from Fibers Sales & Development. It should be noted that such fibres do not normally need precompression for reinforcing the coating structure. Such fibres are preferably added at a level of less than 5% by weight of the coating, more preferably less than 3% by weight. Such fibres are preferably added at a level of more than 0.5% by weight of the coating, more preferably more than 1% by weight.

Detersive Surfactants

Surfactant are typically comprised in a detergent composition. The dissolution of surfactants is favoured by the addition of the highly soluble compound.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1-7 ethoxy sulfates), $C_{10}$–$C_{18}$ alkyl alkoxy carboxylates (especially the EO 1-5 ethoxycarboxylates), the $C_{10-18}$ glycerol ethers, the $C_{10}$–$C_1$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{11}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain C10–$C_{16}$ soaps may be used. Mixtures of anionic and nonionic surfactants are especially useful. Other conventional useful surfactants are listed in standard texts. In a preferred embodiment, the tablet comprises at least 5% per weight of surfactant, more preferably at least 15% per weight, even more preferably at least 25% per weight, and most preferably between 35% and 45% per weight of surfactant.

Non Gelling Binders

Non gelling binders can be integrated in detergent compositions to further facilitate dissolution.

If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: *Acacia*, Alginic Acid, Carbomer, Carboxymethylcellulose sodium, Dextrin, Ethylcellulose, Gelatin, Guar gum, Hydrogenated vegetable oil type 1, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

Non-gelling binder materials are preferably used in an amount within the range from 0.1 to 15% of the composition, more preferably below 5% and especially if it is a non laundry active material below 4% by weight of the tablet.

It is preferred that gelling binders, such as nonionic surfactants are avoided in their liquid or molten form. Nonionic surfactants and other gelling binders are not excluded from the compositions, but it is preferred that they be processed into the detergent tablets as components of particulate materials, and not as liquids.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B). Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0-10) may also be used herein.

Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleach

The detergent compositions herein may optionally contain bleaching agents or bleaching compositons containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. Patent Application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1.000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

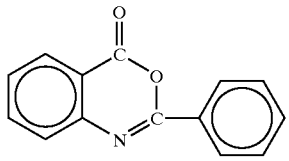

Still another class of preferred bleach activators includes the acyl lactam activators, especially acyl caprolactams and acyl valerolactams of the formulae:

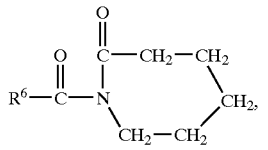

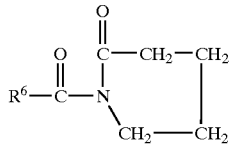

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3(1,4,7\text{-trimethyl-}1,4,7\text{-triazacyclononane})_2(PF_6)_2$, $Mn^{III}{}_2(u\text{-}O)1(u\text{-}Ac)(1,4,7\text{-trimethyl-}1,4,7\text{-triazacyclononane})_2(ClO_4)_2$, $Mn^{IV}{}_4(u\text{-}O)_6(1,4,7\text{-triazacyclononane})_4(ClO_4)_4$, $Mn^{III}Mn^{IV}{}_4(u\text{-}O)_1\ (u\text{-}OAc)_2(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\ (OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. No. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or a 10 stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strains of *Bacillus*, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo.

Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application 130,756, Bott et al, published Jan. 9, 1985).

Amylases include, for example, a-amylases described in British Patent Specification No. 1,296,839 (Novo), RAPIDASE, Internatonal Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and *Humicola* strain DSM1800 or a cellulase 212-producing fungus belonging to the genus *Aeromonas*, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the *Pseudomonas* group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas* gladioli. The LIPOLASE enzyme derived from *Humicola lanuginosa* and commercially available from Novo (see also EPO 341,947) is a preferred lipase for use herein. Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromoperoxidase. Peroxidase-containing detergent compositions are disclosed, for example, in PCT International Application WO 89/099813, published Oct. 19, 1989, by 0. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Other components which are commonly used in detergent compositions and which may be incorporated into detergent tablets include chelating agents, soil release agents, soil antiredeposition agents, dispersing agents, suds suppressors, fabric softeners, dye transfer inhibition agents and perfumes.

The compounds disclosed above for a product are advantageously packed in a packaging system.

A packaging system may be formed from a sheet of flexible material. Materials suitable for use as a flexible sheet include mono-layer, co-extruded or laminated films. Such films may comprise various components, such as poly-ethylene, poly-propylene, poly-styrene, poly-ethylene-terephtalate. Preferably, the packaging system is composed of a poly-ethylene and bi-oriented-poly-propylene co-extruded film with an MVTR of less than 5 g/day/$m^2$. The MVTR of the packaging system is preferably of less than 10 g/day/$m^2$, more preferably of less than 5 g/day/$m^2$. The film (2) may have various thicknesses. The thickness should typically be between 10 and 150 $\mu$m, preferably between 15 and 120 $\mu$m, more preferably between 20 and 100 $\mu$m, even more preferably between 25 and 80 $\mu$m and most preferably between 30 and 40 $\mu$m.

A packaging material preferably comprises a barrier layer typically found with packaging materials having a low oxygen transmission rate, typically of less than 300 $cm^3/m^2$/day, preferably of less than 150 $cm^3/m^2$/day, more preferably of less than 100 $cm^3/m^2$/day, even more preferably of less than 50 $cm^3/m^2$/day and most preferably of less than 10 $cm^3/m^2$/day. Typical materials having such barrier properties include bi oriented polypropylene, poly ethylene terephthalate, Nylon, poly(ethylene vinyl alcohol), or laminated materials comprising one of these, as well as SiOx (Silicium oxydes), or metallic foils such as aluminium foils for example. Such packaging material may have a beneficial influence on the stability of the product during storage for example.

Among the packing method used are typically the wrapping methods disclosed in WO92/20593, including flow wrapping or over wrapping. When using such processes, a longitudinal seal is provided, which may be a fin seal or an overlapping seal, after which a first end of the packaging system is closed with a first end seal, followed by closure of the second end with a second end seal. The packaging system may comprise re-closing means as described in WO92/20593. In particular, using a twist, a cold seal or an adhesive is particularly suited. Indeed, a band of cold seal or a band of adhesive may be applied to the surface of the packaging system at a position adjacent to the second end of the packaging system, so that this band may provide both the initial seal and re-closure of the packaging system. In such a case the adhesive or cold seal band may correspond to a region having a cohesive surface, i.e. a surface which will adhere only to another cohesive surface. Such re-closing means may also comprise spacers which will prevent unwanted adhesion. Such spacers are described in WO 95/13225, published on the 18$^{th}$ of May 1995. There may also be a plurality of spacers and a plurality of strips of adhesive material. The main requirement is that the communication between the exterior and the interior of the package should be minimal, even after first opening of the packaging system. A cold seal may be used, and in particular a grid of cold seal, whereby the cold seal is adapted so as to facilitate opening of the packaging system.

EXAMPLES

Example 1 i) 25 Kg of a detergent base powder of composition A was prepared as follows: all the particulate material of base composition were mixed together in a mixing drum to form a homogenous particulate mixture. During this mixing, the spray-ons were carried out. After preparation the matrix was kept in a sealed plastic bag in a storage room set at a temperature of 23° C. for 24 hours.

ii) Tablets were then made the following way: 50 g of the matrix was introduced into a mould of circular shape with a diameter of 5.5 cm, and compressed to give a tablet tensile strength (or diametrical fracture stress) of 10 kPa. The temperature of the matrix during tabletting ranged between 23 and 27° C.

iii) The tablets were then dipped in a bath comprising 90 parts of sebacic acid and 10 parts per weight of Nymcel-ZSB16™ by Metsa Serla at 140° C. The time the tablet was dipped in the heated bath was adjusted to allow application of 49 of the bath mixture. The tablet was then left to cool at ambient temperature of 25° C. for 24 hours. The tensile strength of the coated tablet was increased to a tensile strength of 30 kPa.

iv) The level of residue in the drawer dispenser of a washing machine was assessed by the following "Tablet dispensing test": two tablets are placed into the dispensing drawer of a Bauknecht WA9850 washing machine, the water supply to the washing machine is set to a temperature of 8° C. and to a hardness of 21 grains per gallon, the flow rate being of 4 liters per minute. The level of tablet residues left in the dispenser is checked after switching on the water flow for 78 seconds. The dispensing percentage residue is determined as follows:

% dispensing=(residue weight)×100/(original weight of both tablets).

| | Composition A (% by weight) |
|---|---|
| Anionic agglomerates 1 | 21.5 |
| Anionic agglomerates 2 | 13.0 |
| Cationic agglomerates | 5.5 |
| Layered silicate | 10.8 |
| Sodium percarbonate | 14.2 |
| Bleach activator agglomerates | 5.5 |
| Sodium carbonate | 10.98 |
| EDDS/Sulphate particle | 0.5 |
| Tetrasodium salt of Hydroxyethane Diphosphonic acid | 0.8 |
| Soil Release Polymer | 0.3 |
| Fluorescer | 0.2 |
| Zinc Phthalocyanine sulphonate | 0.02 |
| Soap powder | 1.4 |
| Suds suppressor | 1.9 |
| Citric acid | 7.1 |
| Protease | 0.8 |
| Lipase | 0.3 |
| Cellulase | 0.2 |
| Amylase | 1.0 |
| Binder spray-on system | 4 |

Anionic agglomerates 1 comprise of 40% anionic surfactant, 27% zeolite and 33% carbonate Anionic agglomerates 2 comprise of 40% anionic surfactant, 28% zeolite and 32% carbonate Cationic agglomerates comprise of 20% cationic surfactant, 56% zeolite and 24% sulphate Layered silicate comprises of 95% SKS 6 and 5% silicate Bleach activator agglomerates comprise of 81% TAED, 17% acrylicimaleic copolymer (acid form) and 2% water.

Ethylene diamine N,N-disuccinic acid sodium salt/Sulphate particle comprise of 58% of Ethylene diamine N,N-disuccinic acid sodium salt. 23% of sulphate and 19% water.

Zinc phthalocyanine sulphonate encapsulates are 10% active.

Suds suppressor comprises of 11.5% silicone oil (ex Dow Corning); 59% of zeolite and 29.5% of water.

Binder spray-on system comprises 25% of Lutensit K-HD 96 and 75% by weight of PEG (Poly Ethylene Glycol).

All % above for composition being by weight.

Example 2 i) 25 Kg of a detergent base powder of composition A was prepared as follows: all the particulate material of base composition were mixed together in a mixing drum to form a homogenous particulate mixture. During this mixing, the spray-ons were carried out. After preparation the matrix was kept in a sealed plastic bag in a storage room set at a temperature of 10° C. for 24 hours.

ii) Tablets were then made the following way: 50 g of the matrix was introduced into a mould of circular shape with a diameter of 5.5 cm, and compressed to give a tablet tensile strength (or diametrical fracture stress) of 10 kPa. The temperature of the matrix during tabletting ranged between 10 and 20° C.

iii) The tablets were then dipped in a bath comprising 90 parts of sebacic acid and 10 parts per weight of Nymcel-ZSB16™ by Metsa Serla at 140° C. The time the tablet was dipped in the heated bath was adjusted to allow application of 4 g of the bath mixture. The tablet was then left to cool at ambient temperature of 25° C. for 24 hours. The tensile strength of the coated tablet was increased to a tensile strength of 30 kPa.

iv) The level of residue in the drawer dispenser of a washing machine was assessed by the following "Tablet dispensing test": two tablets are placed into the dispensing drawer of a Bauknecht WA9850 washing machine, the water supply to the washing machine is set to a temperature of 8° C. and to a hardness of 21 grains per gallon, the flow rate being of 4 liters per minute. The level of tablet residues left in the dispenser is checked after switching on the water flow for 78 seconds. The dispensing percentage residue is determined as follows:

% dispensing=(residue weight)×100/(original weight of both tablets).

Results:

% dispensing for example 1 tablets was found to be 50%, whereas % dispensing for example 2 tablets was found to be 8%.

What is claimed is:

1. A process for making a detergent tablet, the process comprising the steps of: first providing a non-phosphate zeolite-built detergent composition, second, forming a particulate material comprising the detergent composition and third, compressing the particulate material in a tablet form, the process further comprising the step of cooling the detergent composition below ambient temperature between the first and the third steps wherein the ambient temperature is greater than 18° C.

2. A process according to claim 1, wherein the step of cooling the detergent composition consists of exposing the detergent composition to a temperature below ambient temperature in a portion of space.

3. A process according to claim 2, wherein the exposure is achieved by placing or displacing the detergent composition in or through the portion of space in which the temperature is below ambient and at least 3° C.

4. A process according to claim 1 wherein the difference between the ambient temperature and the temperature below ambient is at least 3° C.

5. A process according to claim 3, wherein the time of exposure is proportional to the weight of the detergent composition exposed divided by the difference in temperature.

6. A process according to claim 1, wherein the detergent composition comprises at least 10% by weight of surfactant.

7. A process according to claim, 1, wherein the detergent composition comprises at least 2% by weight of binder.

8. A process according to claim 1, wherein the detergent composition has a temperature below ambient temperature after the cooling step and before the third step.

* * * * *